US007121837B2

(12) United States Patent
Sato et al.

(10) Patent No.: US 7,121,837 B2
(45) Date of Patent: Oct. 17, 2006

(54) CONNECTOR

(75) Inventors: Shiho Sato, Shinagawa (JP); Takeshi Ito, Shinagawa (JP); Noboru Shimizu, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/387,831

(22) Filed: Mar. 14, 2003

(65) Prior Publication Data

US 2004/0005791 A1 Jan. 8, 2004

(30) Foreign Application Priority Data

Jul. 2, 2002 (JP) ..... 2002-193884

(51) Int. Cl.
*H01R 12/00* (2006.01)

(52) U.S. Cl. ..... 439/66

(58) Field of Classification Search ..... 439/66, 439/67, 591, 69, 74, 91
See application file for complete search history.

(56) References Cited

U.S. PATENT DOCUMENTS 3,851,297 A * 11/1974 Munro ..... 439/66
4,552,420 A * 11/1985 Eigenbrode ..... 439/67
4,693,530 A * 9/1987 Stillie et al. ..... 439/67
5,069,627 A * 12/1991 Buck et al. ..... 439/66
5,102,343 A * 4/1992 Knight et al. ..... 439/67
5,163,834 A * 11/1992 Chapin et al. ..... 439/66
5,175,154 A * 12/1992 Schwartz et al. ..... 514/172
5,259,770 A * 11/1993 Bates et al. ..... 439/66
5,273,439 A * 12/1993 Szerlip et al. ..... 439/66
5,430,614 A * 7/1995 Difrancesco ..... 361/785
5,575,661 A * 11/1996 Grabbe et al. ..... 439/62
5,737,837 A * 4/1998 Inaba ..... 29/884
5,766,023 A * 6/1998 Noschese et al. ..... 439/74
5,911,584 A * 6/1999 Larsen et al. ..... 439/67
5,917,709 A * 6/1999 Johnson et al. ..... 361/803
6,368,147 B1 * 4/2002 Swanson ..... 439/496

* cited by examiner

*Primary Examiner*—Briggitte R. Hammond
(74) *Attorney, Agent, or Firm*—Staas & Halsey LLP

(57) ABSTRACT

A new connector that is reduced in size and has a higher density of contacts implemented therein is provided. This connector has a contact module arranged on a connector main body. The contact module is formed into a sheet structure, and a plurality of contacts are arranged therein. Further, the contact module is bent into a C-shaped structure along the extending direction of the contacts, and is implemented to the connector main body in this state. Contact points of the connector are energized by sets of a coil spring and two push pins arranged on both sides of the coil spring so that these contact points protrude from holes formed at the connector main body.

8 Claims, 15 Drawing Sheets

CONNECTOR

BACKGROUND OF THE INVENTION

1. Field of the Invention

The present invention relates to a connector.

2. Description of the Related Art

A connector is used to electrically connect a plurality of electronic devices or electronic parts.

The connector can be classified into various types according to its configuration and the like.

For example, based on mount mode, connectors can be divided into a substrate connector that is connected to a substrate, an LSI socket that is connected to an LSI, and a relay connector that is used for connecting a cable to another cable.

Among the different types of connectors mentioned above, the substrate connectors can be further divided into a card edge type connector and a two-piece type connector.

FIGS. 1 and 2 show examples of the card edge type connector used to connect a mother board 1 to a daughter card 2, wherein pads 3 arranged on patterns (not shown) formed at both sides of the daughter card 2 are held between a pair of contacts 4. Thus, in this configuration, the patterns of the daughter card 2 are used as inserting contacts. A connector 5*a* shown in FIG. 1 is a through hole mount type connector. That is, the connector 5*a* is mounted to the mother board 1 by inserting one end of each of the contacts 4 through a corresponding through hole (not shown) formed at the mother board 1 and fixing the contacts 4 to the mother board 1 through soldering. On the other hand a connecter 5*b* shown in FIG. 2 is a surface mount type connector. That is, the connector 5*b* is mounted to the mother board 1 by fixing one end of each of the contacts 4 to a corresponding pad 6 formed on the mother board 1 through soldering.

FIG. 3 shows an example of the two-piece type connector. In this drawing a connector 5*c* has two connectors 5*c*-1 and 5*c*-2, one being inserting and the other being receiving, and the two connectors are each mounted on different substrates 1 and 7. The connector 5*c* is used by engaging the two connectors 5*c*-1 and 5*c*-2.

As described above, the connector may have various configurations depending on its mount mode and the like; however, the above substrate connector, the LSI socket, and the relay connector all have a housing (corresponding to the parts indicated by numeral 8 in FIGS. 1–3) made of insulating resin that accommodate numerous pin-shaped or tongue-shaped contacts made of metal.

To form a press-fit type pin contact, sheet metal is processed by die cutting, punching, bending, or forming press to produce a number of presswork pin contacts. Also, for fabricating tongue-shaped contacts, sheet metal is die-cut or punched in a similar fashion. Sheet metal is normally used for the contacts so as to obtain spring characteristics. Also, the contact is plated with a base plating and then with gold in order to obtain good conductivity.

Like many electronic parts such as a wiring board and the like, the development of the connector has always been concerned with size reduction and achievement of a higher density (narrower pitch) of the contacts, that is, a larger number of contacts to be implemented in the connector.

However, since the conventional connector has contacts that are pin-shaped, it can be rightly assumed that there is a limit to reducing the size of the connector or increasing the density of the contacts. For example, with regard to the density of the contacts, it is difficult to achieve a pitch that-is lower than 0.2–0.3 mm.

Also, in the conventional two-piece connector, two connectors are used, thereby imposing a further limit on attempts to reduce the size of the connector. Also, in this conventional two-piece connector, there is also a problem of noise being generated at the connecting portion of the two connectors.

SUMMARY OF THE INVENTION

The present invention has been developed in response to the above-mentioned problems of the related art, and its object is to provide a new connector that is reduced in size and has an increased density of contacts implemented therein.

A connector according to the present invention is a connector that connects the principal planes of two substrates, and includes:

a connector main body; and a contact module that is arranged on the connector main body; wherein the contact module includes:

a sheet made of metal;

an insulating film formed on the sheet; and a contact point and a circuit pattern that are thin films of precious metal formed on the insulating film; wherein:

a plurality of the contact points and the circuit patterns are arranged to form a plurality of contacts, the contact module being bent into a C-shaped structure along an extending direction of the contact to be implemented on the connector main body, the two protruding portions of the C-shaped structure of the contact corresponding to the contact points.

Another connector according to the present invention is a connector implemented in a testing apparatus that performs a continuity test on a semiconductor device, the connector connecting a circuit of said testing apparatus and a terminal of a substrate that is electrically connected to the semiconductor device, and including:

a connector main body; and a contact module that is arranged on the connector main body; wherein:

the contact module includes:

a sheet made of metal;

an insulating film formed on the sheet; and a contact point and a circuit pattern that are thin films of precious metal formed on the insulating film; wherein:

a plurality of the contact points and the circuit patterns are arranged to form a plurality of contacts, the contact module being bent into a C-shaped structure along an extending direction of the contact to be implemented on the connector main body, the two protruding portions of the C-shaped structure of the contact corresponding to the contact points.

In the above connectors of the present invention, the circuit pattern includes a wiring pattern or some other type of wiring. Also, the contact point and the circuit pattern may be made of materials other than precious metal, that is, the present invention does not exclude base metal as the component material of the contact point and the circuit pattern. However, precious metal is preferably used in order to obtain a contact with good mechanical characteristics such as abrasion resistance, environmental resistance, and corrosion resistance. Further, in the present invention, one type of precious metal may be used, or a plurality of types of precious metals may be used as the material of the contact and the circuit pattern. Additionally, the insulating film, the contact point, and the circuit pattern may be formed on one side of the sheet or on both sides of the sheet.

According to the above invention, the contact module is formed into a sheet structure using a sheet with a predetermined thickness as a base foundation. Thereby, the above contact module is provided with flexibility and a desired configuration according to the usage mode of the connector can be realized upon implementing the contact module to the connector main body.

Also, since the contact can be formed into a thin sheet and a large number of contacts can be intricately arranged at a narrow pitch, the size of the connector can be reduced and the density of the contacts can be increased.

Additionally, by using the connector according to the present invention for connecting two substrates, the size of the connector can be reduced compared to the case in which the conventional two-piece type connector is used, and the problem of noise being generated at the connecting portion of the two connectors of the conventional two-piece connector can be resolved.

Further, a push member that applies pressure to the contact points so as to push open the two protruding portions of the C-shaped structure of the contact is preferably arranged inside the two protruding portions of the C-shaped structure so that better contact force can be obtained.

In the above case, the push member preferably includes at least a pair of slide members that can slide out to push each of the contact points corresponding to the two protruding portions, and an elastic member, arranged between the pair of slide members, that controls the pair of slide members to slide out and push the contact points.

Alternatively, the push member may include at least a pair of slide members that can slide out to push each of the contact points corresponding to the two protruding portions, and a positioning member, arranged between the pair of slide members, that determines the position of the connector at a state in which the pair of slide members is slid out and pushing said contact points.

DESCRIPTION OF THE PREFERRED EMBODIMENTS

In the following, preferred embodiments of the connector according to the present invention are described with reference to the accompanying drawings.

Figure 1:
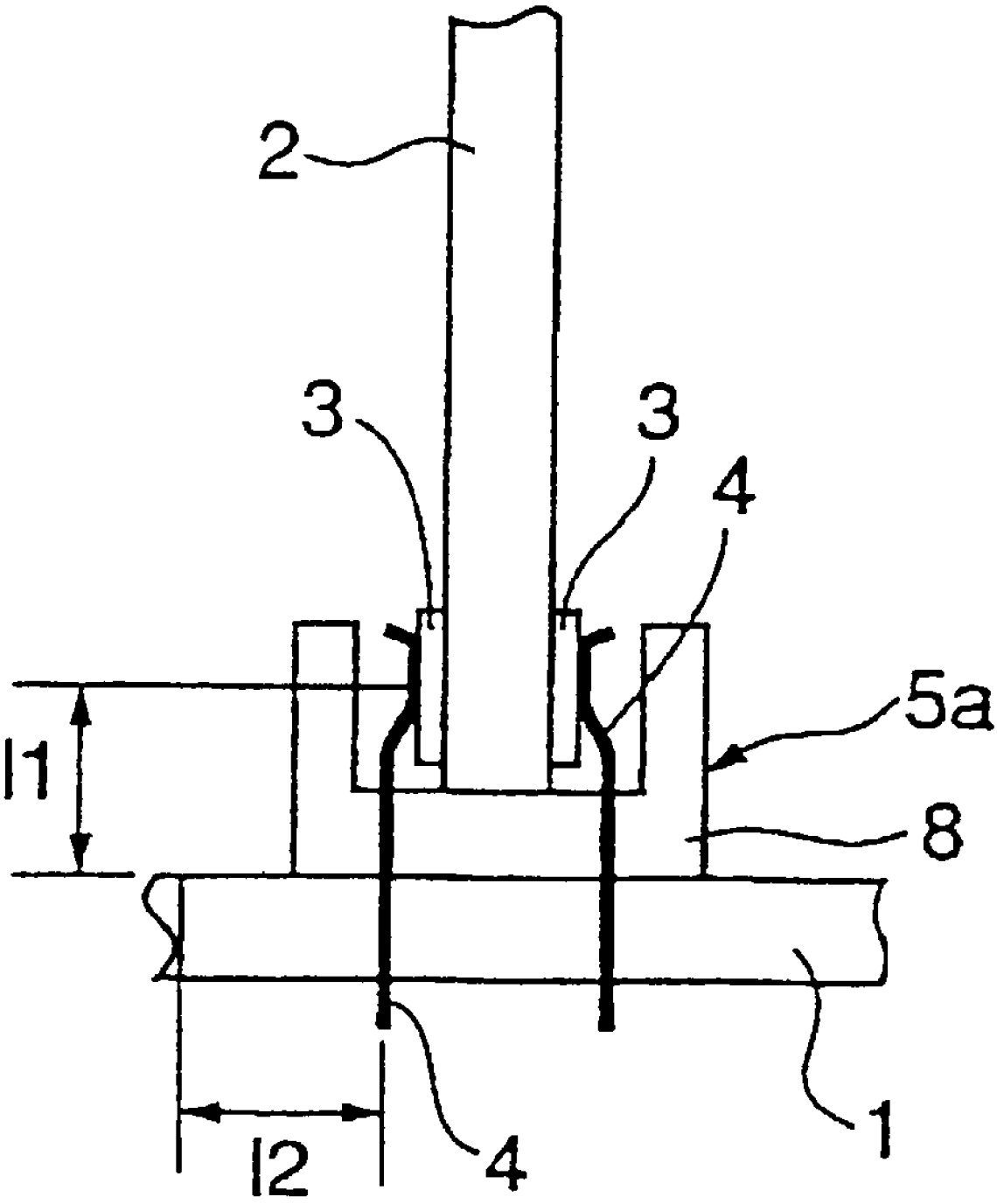
FIG.1 PRIOR ART
FIG. 1 is a schematic diagram showing a configuration of a card edge type connector according to the conventional art.
Figure 2:
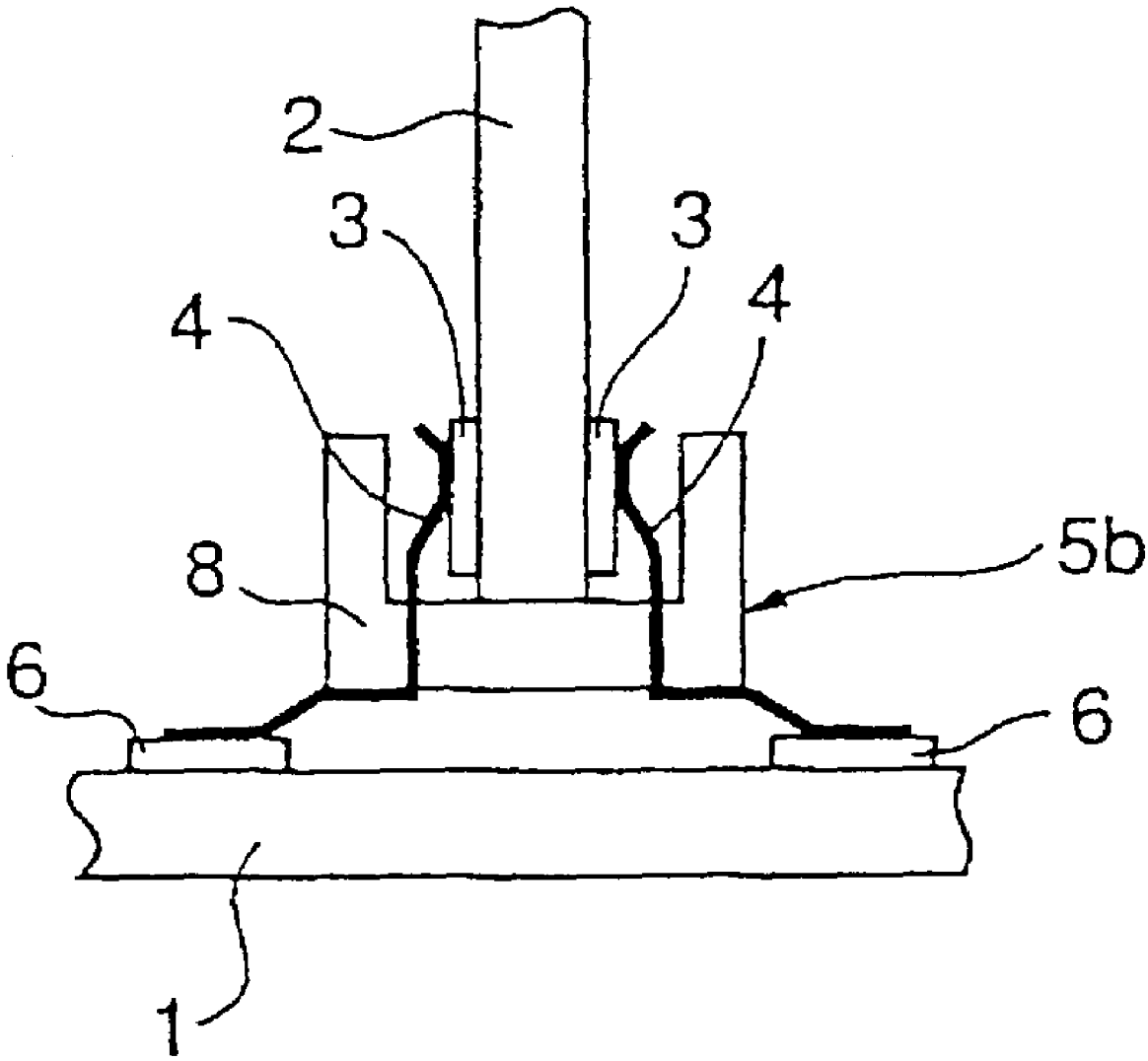
FIG.2 PRIOR ART
FIG. 2 is a schematic diagram showing another configuration of a card edge type connector according to the conventional art.
Figure 3:
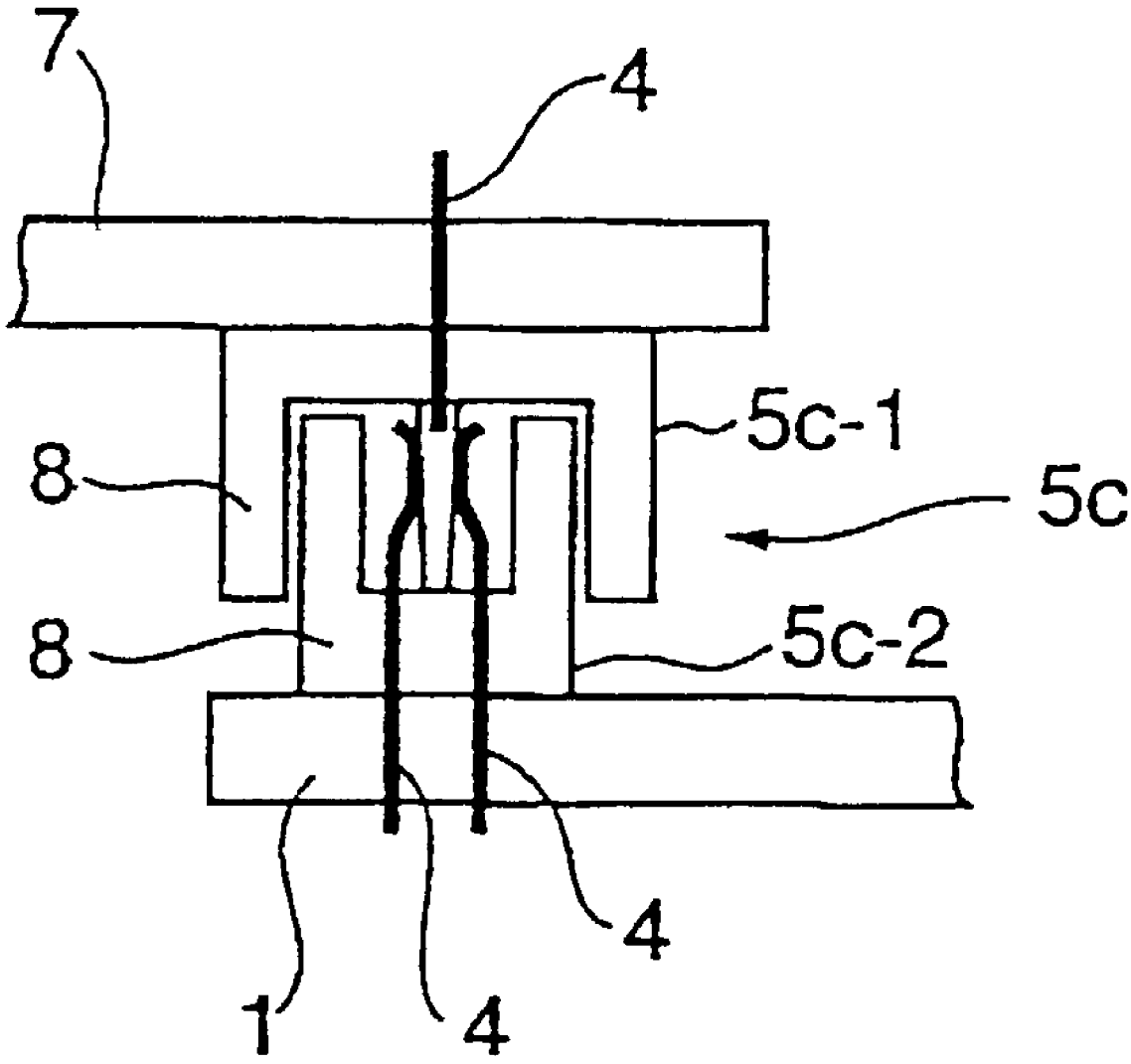
FIG.3 PRIOR ART
FIG. 3 is a schematic diagram showing a configuration of a two-piece type connector according to the conventional art.
Figure 4:
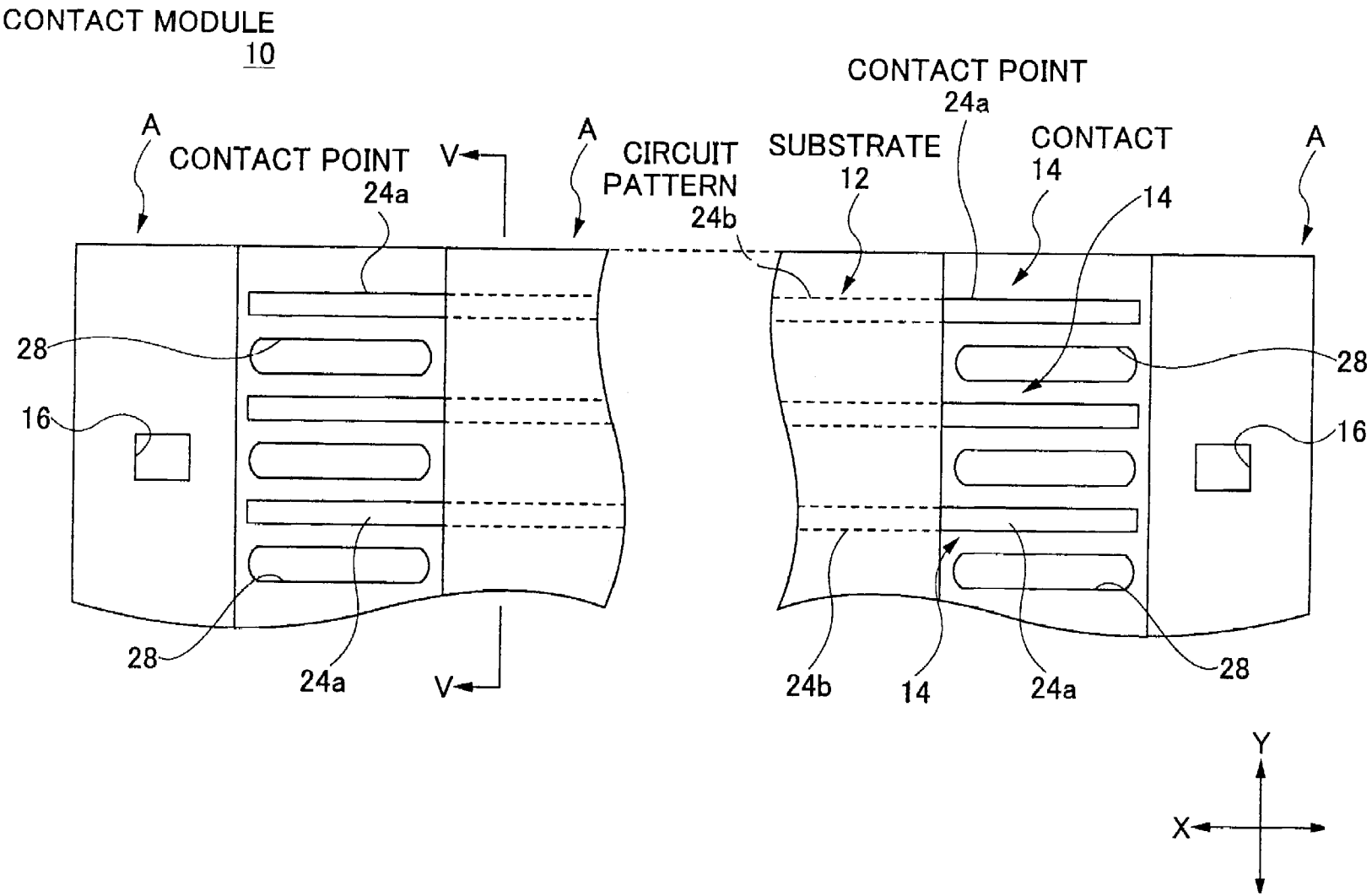
FIG. 4 is a plan view of a portion of a contact module according to an embodiment of the present invention.
Figure 5:
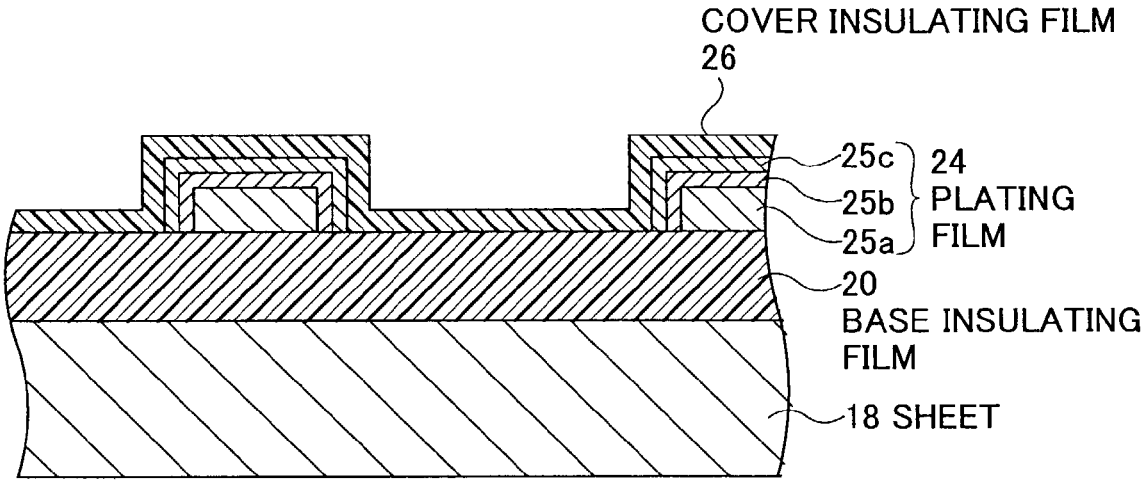
FIG. 5 is a cross sectional view of the contact module shown in FIG. 4 cut across the V—V line.

First, referring to FIGS. 4 and 5, a contact module that is implemented in a connector according to an embodiment of the present invention is described. FIG. 4 is a plan view of a portion of a contact module according to an embodiment of the present invention; and FIG. 5 is a cross sectional view of the contact module shown in FIG. 4 cut across the V—V line.

A contact module 10 according to an embodiment of the present invention shown in FIGS. 4 and 5 is formed into a sheet structure before being implemented to the connector. The contact module 10 has a plurality of contacts 14, each extending in a direction X, and arranged at a predetermined pitch in a direction Y as shown in FIG. 4.

The contact module 10 is a single (one-piece) type contact module and the contacts 14 are used for signal transmission. At both ends of the contact module 10, a plurality of rectangular holes 16 are formed (in FIG. 4, one hole 16 is shown at each of the left and right ends of the contact module 10). The function of the hole 16 will be described later on.

FIG. 5 shows a cross sectional view of the above-described contact 14 of the contact module 10. Herein, a base insulating film 20, a plating film 24, and a cover insulating film 26 are laminated onto a sheet 18 in this order. The cover insulating film 26, which is the upper most layer, is implemented only on a base portion 12 of the contact 14 and the two side portions with respect to the longitudinal direction of the contact module 10 (indicated by arrows A in FIG. 4). At the other portions of the contact 14 (i.e. contact points and its surrounding portions that will be described later on), the plating film 24 is exposed or at places where the plating film 24 is not formed, the base insulating film 20 is exposed. The upper most cover insulating film 26 can also be omitted altogether.

The plating film 24 is made of metallic material. The metallic material may be of one single precious metal or a plurality of precious metals, or it may be in the form of a lamination of metals. In FIG. 5, the plating film 24 has a three-layer structure that includes a copper plating film 25*a*, a nickel plating film 25*b*, and a gold plating film 25*c* (in this order starting with the layer closest to the base insulating film 20). In this structure, electrical characteristics, corrosion resistance, and lubricity can be secured by the copper plating film 25*a* and the gold plating film 25*c*, and abrasion resistance can be secured by the nickel plating film 25*b*. The thickness of the plating film 24 is, for example, in the order of 14 μm, and herein, the thickness of the copper plate film 25*a* is, for example, in the order of 12 μm.

The sheet 18 is the base foundation of the laminated structure and provides a certain amount of durability to each contact 14 or contact module 10 and also secures the spring characteristics of the contact 14. The sheet 18 is made of metallic material. For example, SUS material can be used as this metallic material. Also, when copper alloy material is used instead of the SUS material, better conductivity can be obtained. The thickness of the sheet 18 may be in the order of 50 μm, for example.

The base insulating layer 20 is for insulating the sheet 18 and the base plate film 24. The cover insulating film 26 is for protecting the plating film 24. The base insulating film 20 and the cover insulating film 26 may be made of insulating resin material, for example. Preferably, polyimide resin is used as the insulating resin material; however, other resin materials such as polyethylene terephthalate resin or epoxy resin may be used as well. Also, other insulating materials such as inorganic materials may be used instead of the insulating resin material for the base insulating film 20 and the cover insulating film 26. The thickness of the base insulating material 20 may be in the order of 18 μm, for example, and the thickness of the cover insulating layer 26 may be in the order of 3 μm, for example. Further, a base plating film may be implemented between the base insulating layer 20 and the plating film 24 if its necessity arises. The base plating film is used for enhancing the adhesiveness of the plating film 24, and this is formed using conductive metallic material such as copper.

The plating film 24 has contact points 24*a* that are arranged at portions close to the ends of the contact 14 (contact module 10), and circuit patterns 24*b* arranged at the portions between the contact points 24*a*. Herein, the circuit pattern 24*b* has approximately the same width as the contact points 24*a*, which may be in the order of 30 μm, for example.

Also, a slit 28 is formed in between two contact points 24*a* of two adjacent contacts 14. The function of this slit 28 will be described later on.

The contact module 10 as described above may be manufactured by laminating each film, and then cutting and bending the structure using, for example, technology for creating a suspension of a head portion of a hard disk drive apparatus.

Because the contact module 10 according to this embodiment of the present invention is formed into a sheet structure using the sheet 18 having a predetermined thickness as a base foundation, flexibility is allowed in the contact module 10 and a desired configuration according to the usage mode of the connector can be realized.

Also, in the contact module 10, the contacts 14 can be formed into a thin sheet and a large number of contacts 14 can be intricately arranged at a narrow pitch. Thus, the size of the connector can be reduced and the density of the contacts 14 implemented in the connector 10 can be increased (the contact pitch can be narrowed). For example, with regard to increasing the density of the contacts 14, the contact pitch can be narrowed down to approximately 0.1 mm.

Further, in the contact module 10, the circuit patterns 24*b* of the contacts 14 are covered by an insulating film so that only the contact points 24*a* are exposed. Thus, when using the connector implementing the contact module 10, the circuit pattern portions of the contacts can be protected from snapping due to friction and damage upon coming into contact with other parts such as the substrate.

Figure 6:
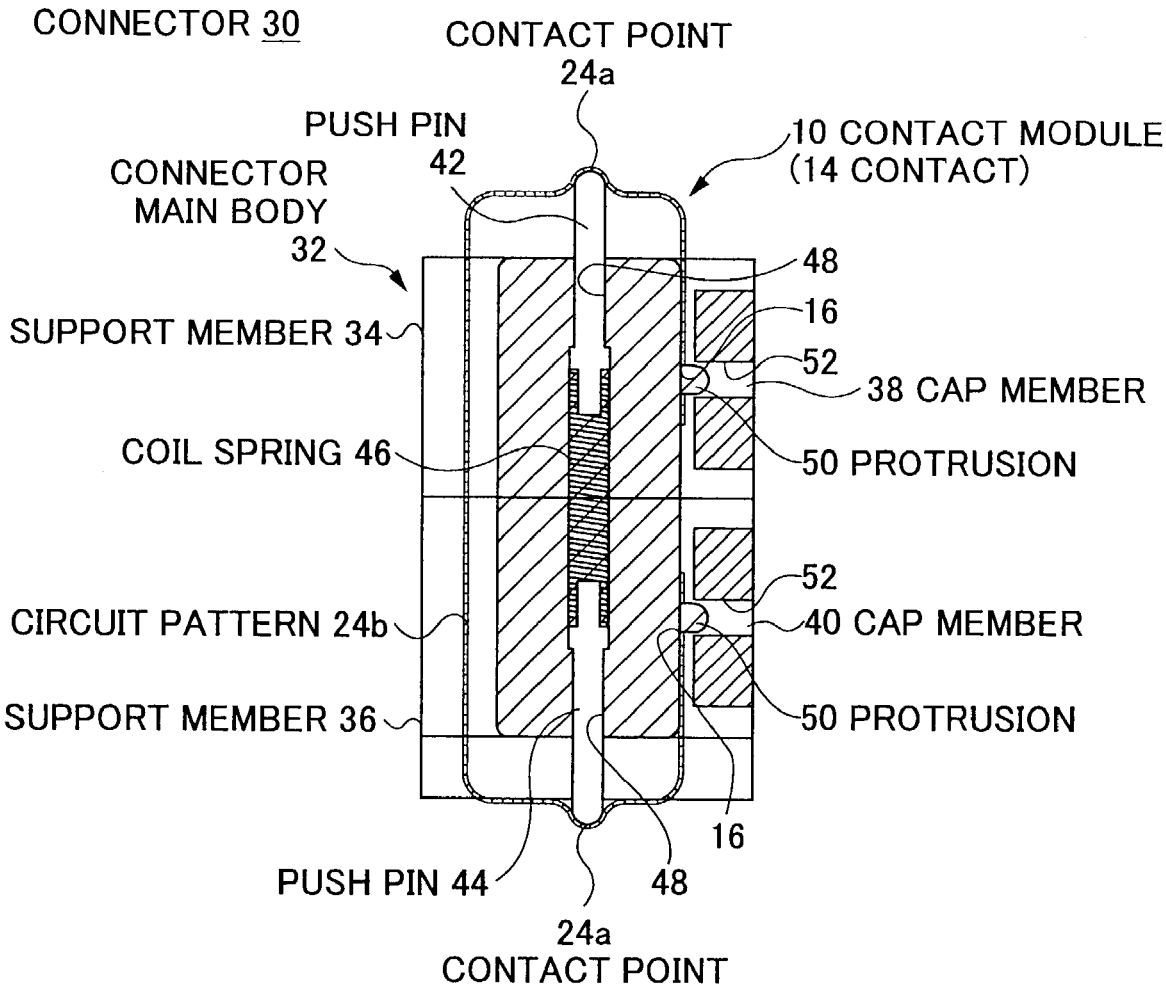
FIG. 6 is a cross sectional view of a connector according to a first embodiment of the present invention.
Figure 7:
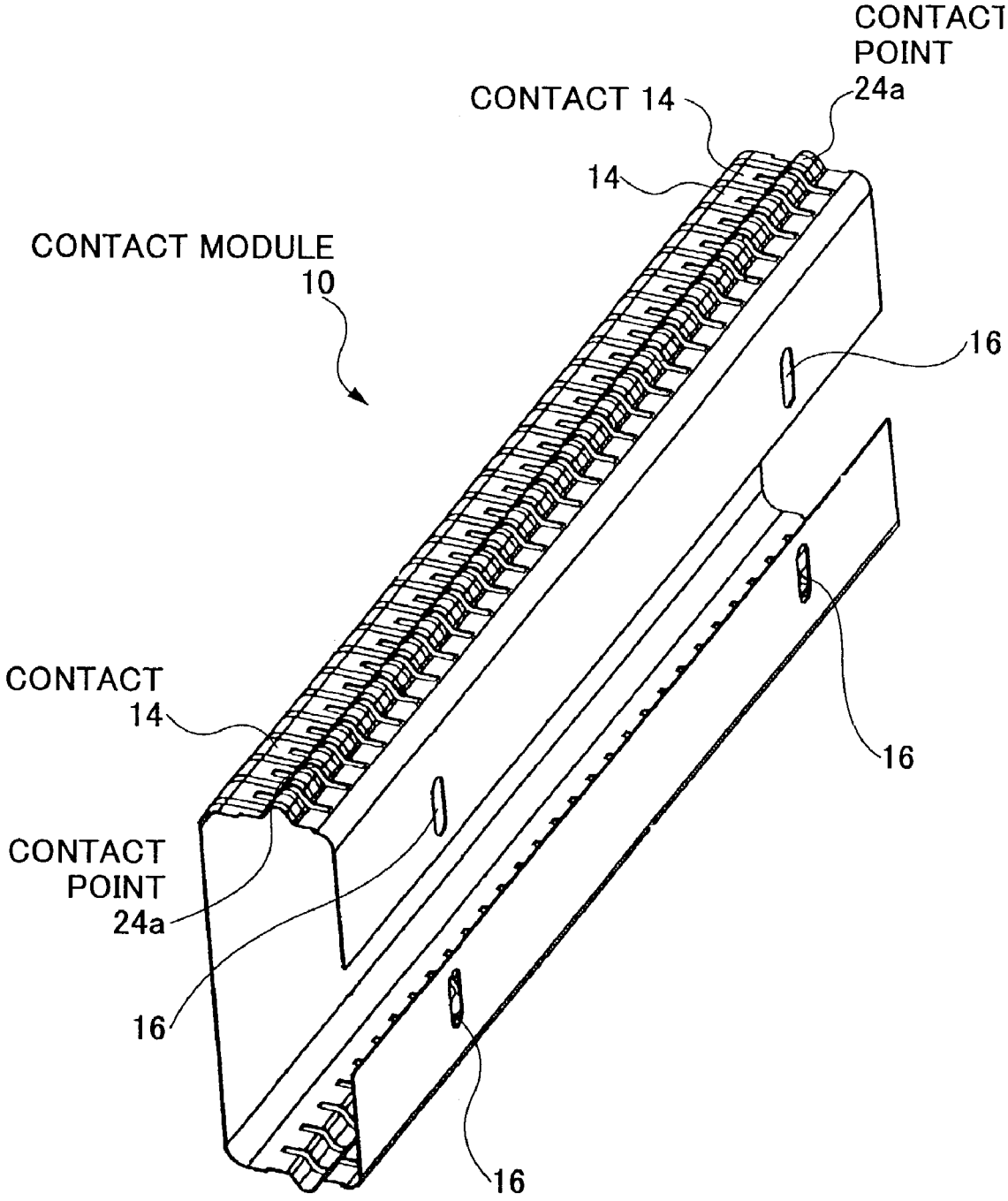
FIG. 7 is a perspective view of a contact module of the connector shown in FIG. 6.
Figure 8:
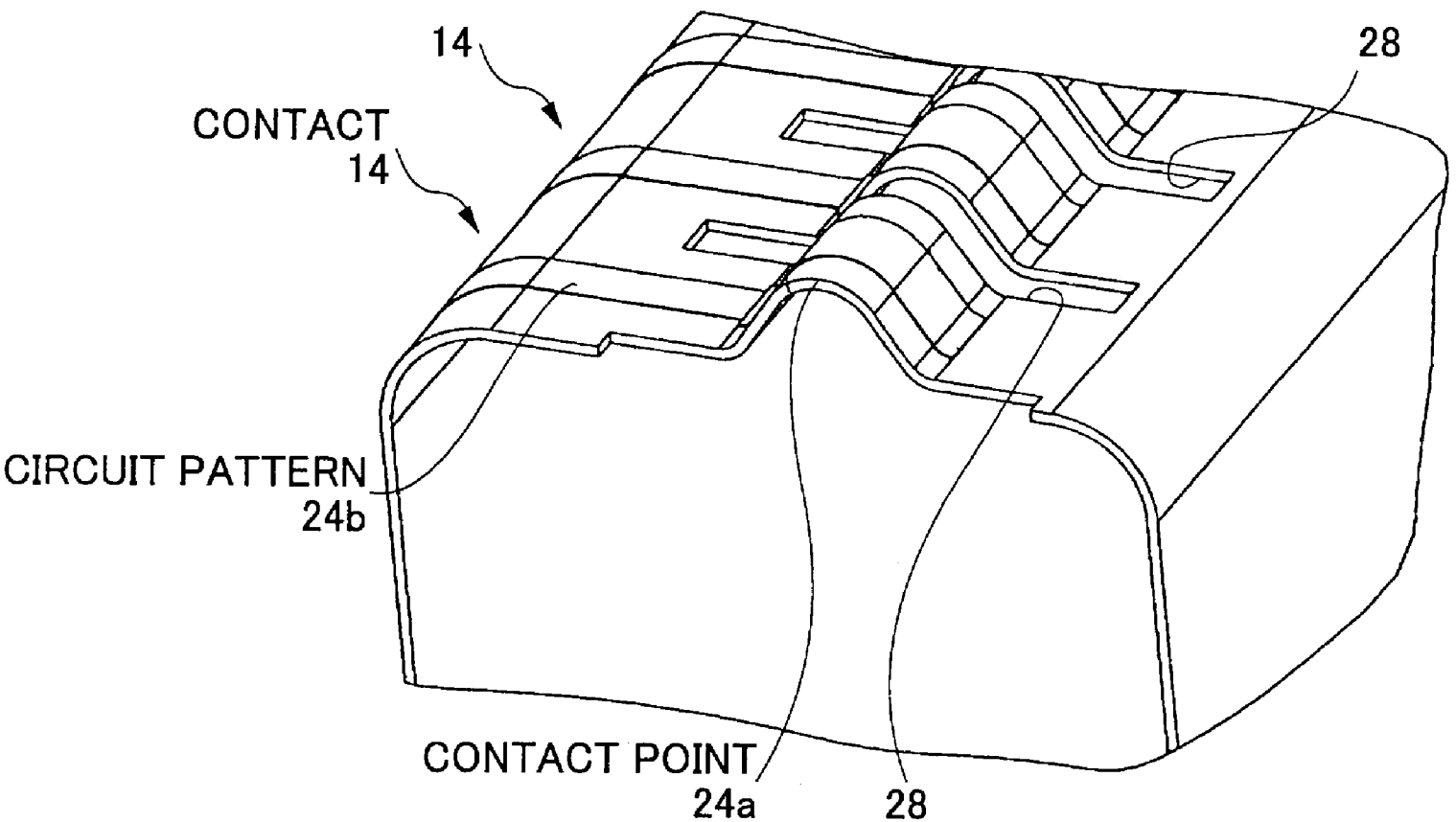
FIG. 8 is an enlarged view of a portion of the contact module shown in FIG. 7.

In the following, a connector according to a first embodiment of the present invention that implements the above contact module 10 will be described with reference to FIGS. 6–8. FIG. 6 is a cross sectional view of the connector according to the first embodiment of the present invention; FIG. 7 is a perspective view of the contact module 10; and FIG. 8 is an enlarged view of a portion of the contact module 10 shown in FIG. 7.

In FIG. 6, a connector 30 according to the first embodiment of the present invention has the module 10 formed into a sheet structure as described above that is bent into a C-shape along the extending direction of the contacts 14 to be implemented to a connector main body 32.

The upper and lower contact points 24*a* of the contacts 14 of the contact module 10 protrude outward from both the upper and lower edges of the C-shaped contact 14 and form a convex shape. Thus, the contact points are prevented from receiving interference from surrounding portions. Also, since the slit 28 is formed between the convex-shaped contact points 24*a*, the contact points 24*a* are provided with spring characteristics and thereby sufficient contact force can be obtained.

Figure 9:
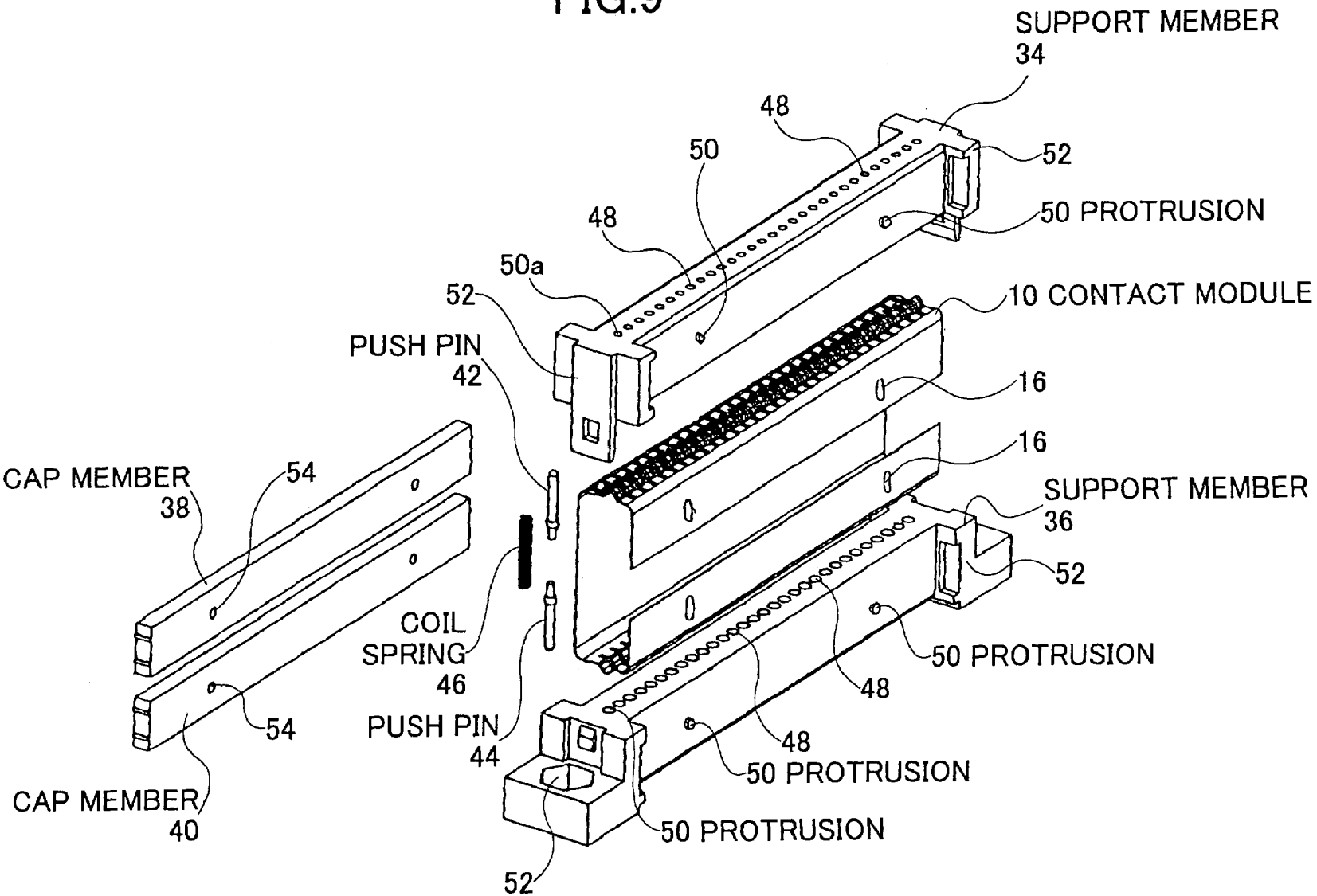
FIG. 9 is a perspective view of the component pieces of the connector shown in FIG. 6.
Figure 10:
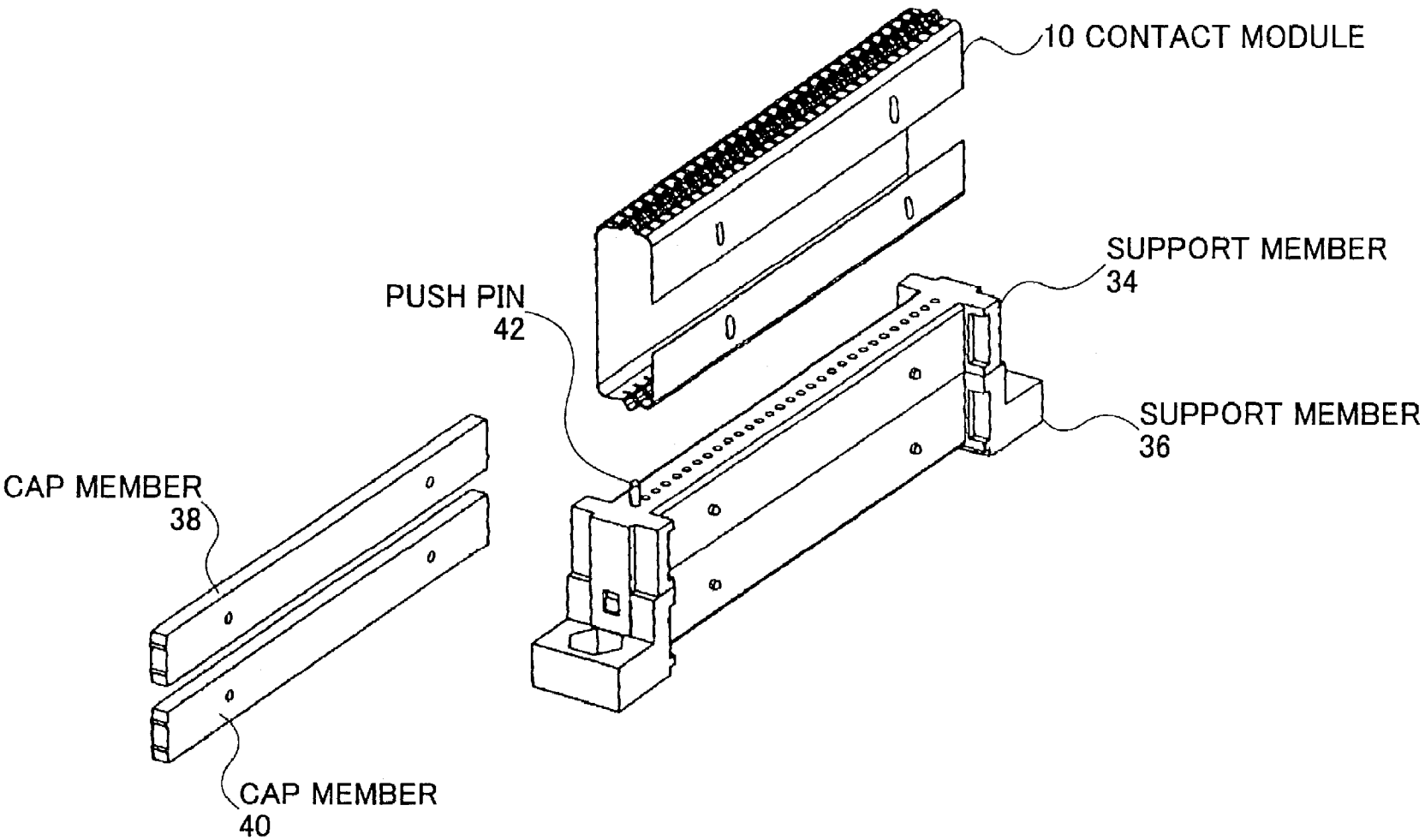
FIG. 10 is a perspective view of a state in which support members of the connector shown in FIG. 6 are engaged.

The connector main body 32 has a pair of support members 34 and 36, a pair of cap members 38 and 40, a pair of push pins (slide members) 42 and 44, and a coil spring (elastic member) 46 (see FIGS. 6 and 9). The push pins 42 and 44, and the coil spring 46 make up a push member of the present invention.

In the following, the construction of the connector 30 is described with reference to FIGS. 9–12.

The support members 34 and 36 are long strips extending along the alignment direction of the contacts 14. The support members 34 and 36 have numerous holes 48 at which the contact points 24*a* of the contact module 10 protrude. Also, a plurality of protrusions 50 are formed on one side of each of the support members 34 and 36. Further, engaging members 52 are formed at both ends of each of the support members 34 and 36 (see FIG. 9).

The push pins 42 and 44 are engaged at both ends of the coil spring 46, and the free ends of the push pins 42 and 44 are inserted through a hole 50*a* formed at the end portions of the support members 34 and 36. The support members 34 and 36 are engaged and fixed to each other by the engaging members 52 so that the coil spring 46 and the push pins 42 and 44 are locked in place (see FIG. 10).

Figure 11:
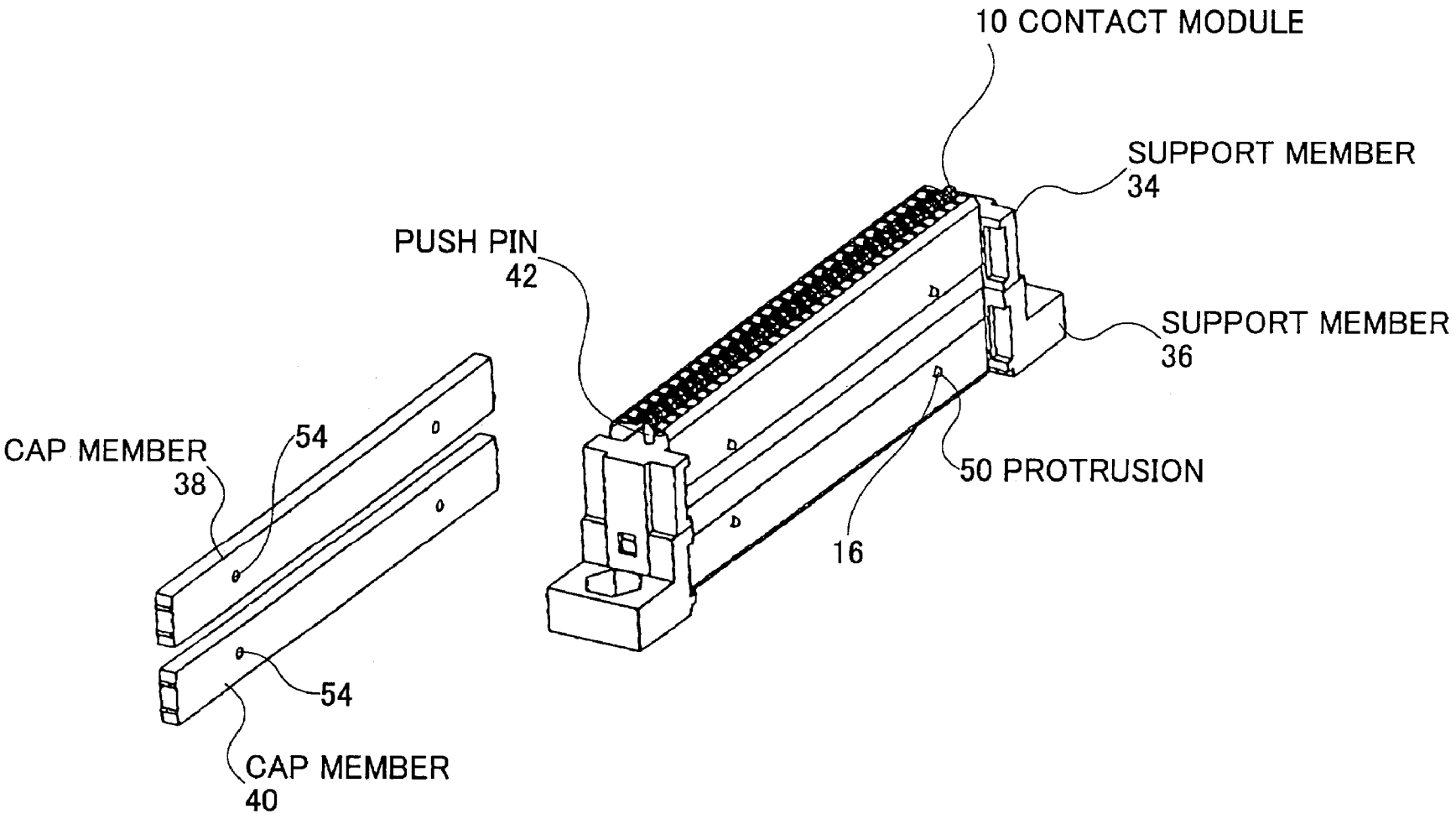
FIG. 11 is a perspective view of a state in which the contact module of the connector shown in FIG. 6 is arranged on the support members.
Figure 12:
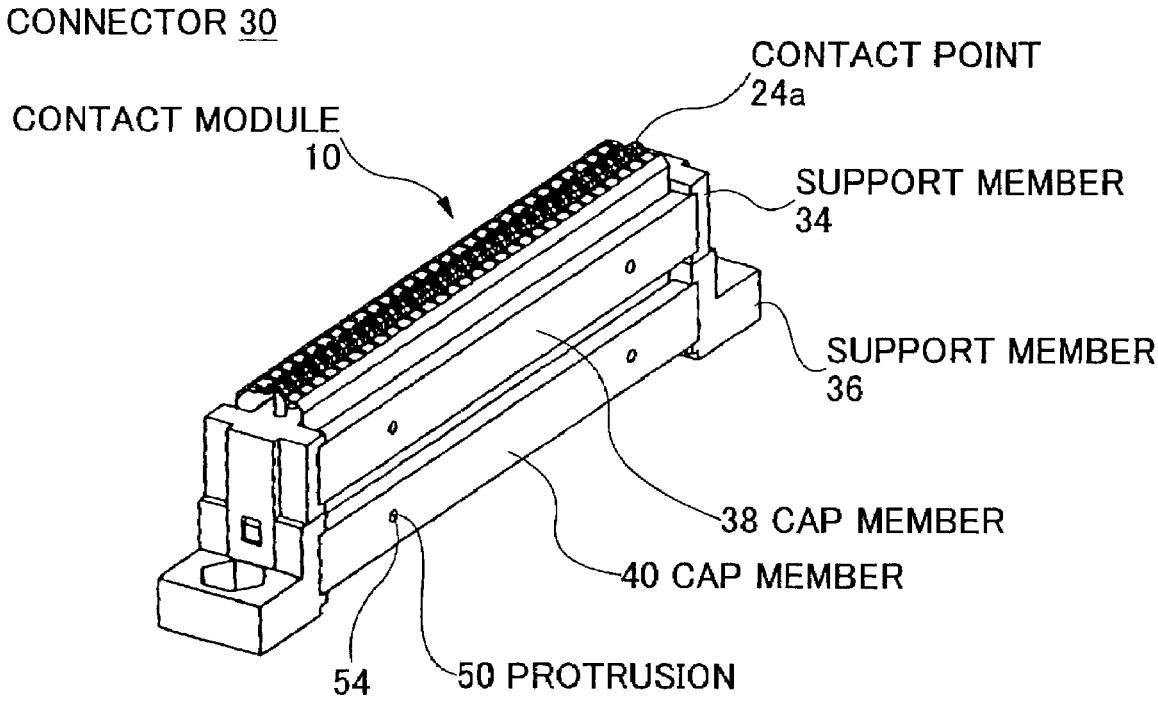
FIG. 12 is a perspective view of the completed assemblage of the connector shown in FIG. 6.

Then the contact module 10 is wrapped around the support members 34 and 36, and the protrusions 50 of the connector main body 32 are inserted into the holes 16 of the contact module 10 (see FIG. 11).

Further, the cap members 38 and 40 are pressed onto the upper and lower sides of the contact module 10 that have the holes 16 formed, and the protrusions 50 are inserted into the holes 54 formed at each of the cap members 38 and 40 so that the cap members 38 and 40 are fixed to the support members 34 and 36. In this way, the connector 30 is assembled (see FIG. 12). The contact points 24*a* of the connector 30 are energized by the coil spring 46, and the push pins 42 and 44 so as to protrude from the holes 48.

Figure 13:
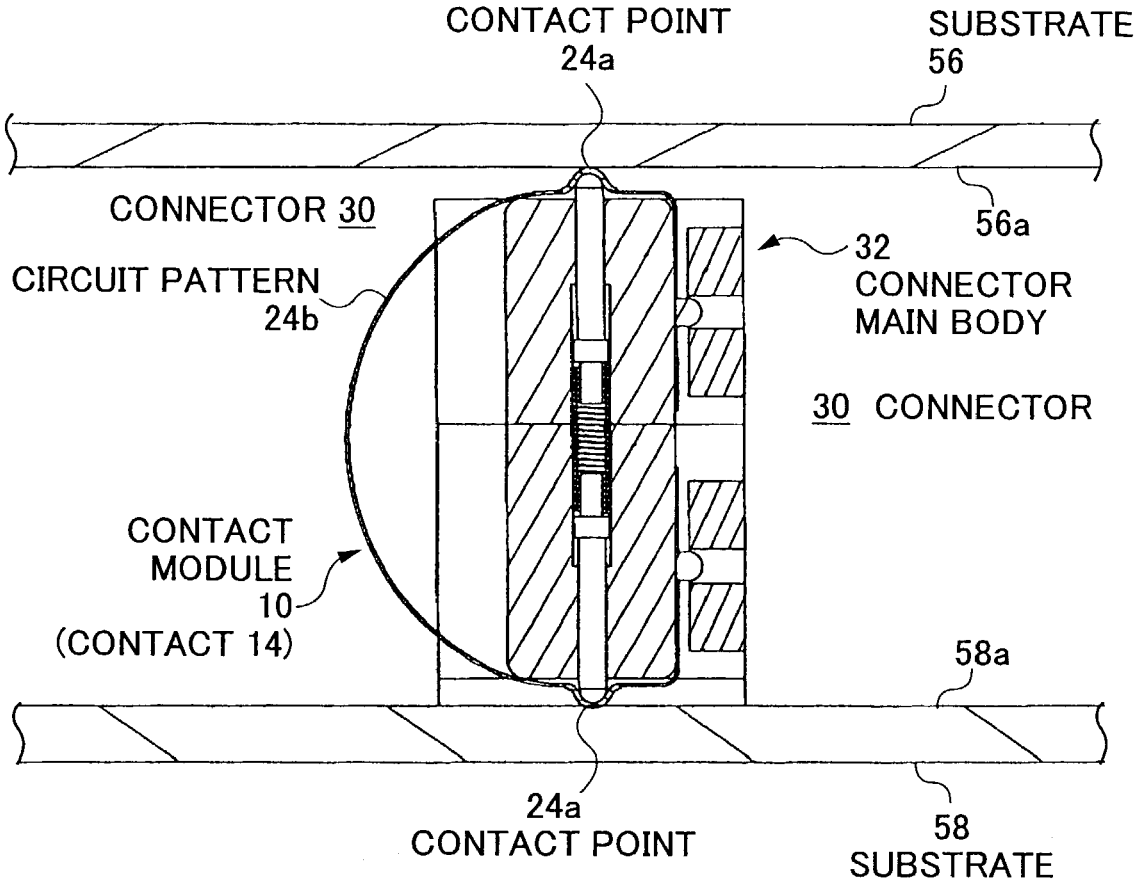
FIG. 13 shows a state in which the connector shown in FIG. 6 is arranged between two substrates.

In the following, a structure in which the above connector 30 is used to connect the principal planes of two substrates is described with reference to FIG. 13.

The connector 30 is arranged between terminals or pads (not shown) formed on the principal planes 56*a* and 58*a* of two substrates 56 and 58. By adjusting the distance between the substrates 56 and 58, the contact points 24*a* are pressed by the substrates 56 and 58. Further, the pressure from these substrates and the pressure from the coil spring 46 are balanced out. Thereby, the contact points 24*a* are slightly pressed back towards the connector main body 32, and the circuit patterns 24*b* curve outward. The connector 30 is fixed in between the substrates 56 and 58 using a suitable fixing member. In this way, the terminals (pads) of the substrates 56 and 58 can come into contact with the contact points 24*a* with a suitable contact force.

In the above described connector 30 according to the first embodiment of the present invention, the contact 14 can be formed into a thin sheet and a large number of contacts 14 can be intricately arranged at a narrow pitch. Thereby, the size of the connector can be reduced and the density of the contacts can be increased.

Also, by using the connector 30 according to the present embodiment for connecting the two substrates 56 and 58, the size of the connector can be reduced as well as its cost compared to a case in which the conventional two-piece connector is used, and the problem of noise that may be generated at the connecting portion of the two connectors in the conventional connector can be resolved.

Figure 14:
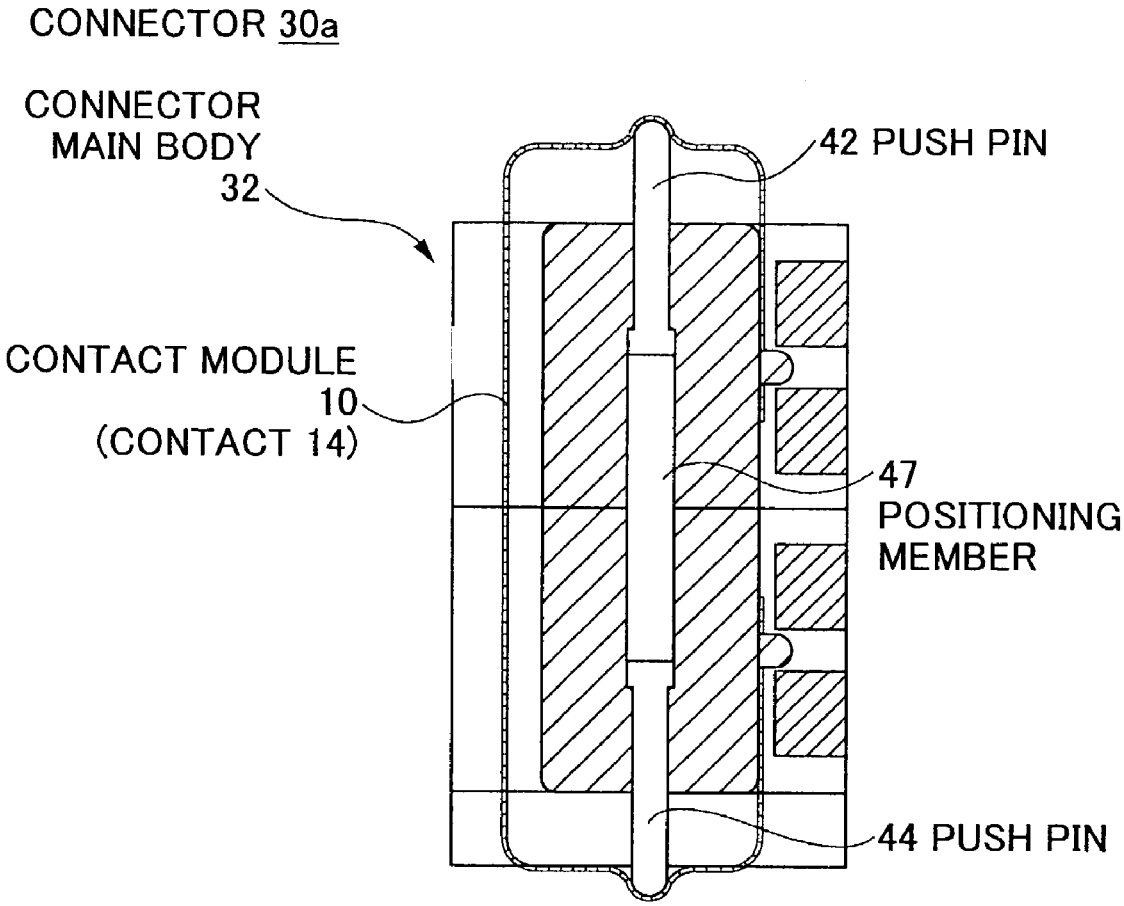
FIG. 14 is a cross sectional view of an exemplary modification of the connector according to the first embodiment of the present invention.

The connector 30 may be modified to have a configuration shown in FIG. 14. In this drawing, a connector 30*a* has a positioning member 47 instead of the coil spring 46. This positioning member 47, arranged between the pair of push pins 42 and 44, correctly positions the push pins 42 and 44 so as to push the contact points 24*a* by sliding the push pins. The coil spring 46 may also be used together with the positioning member 47. The above-described modifications can be applied to a connector 60 according to a second embodiment of the present invention as well.

Figure 15:
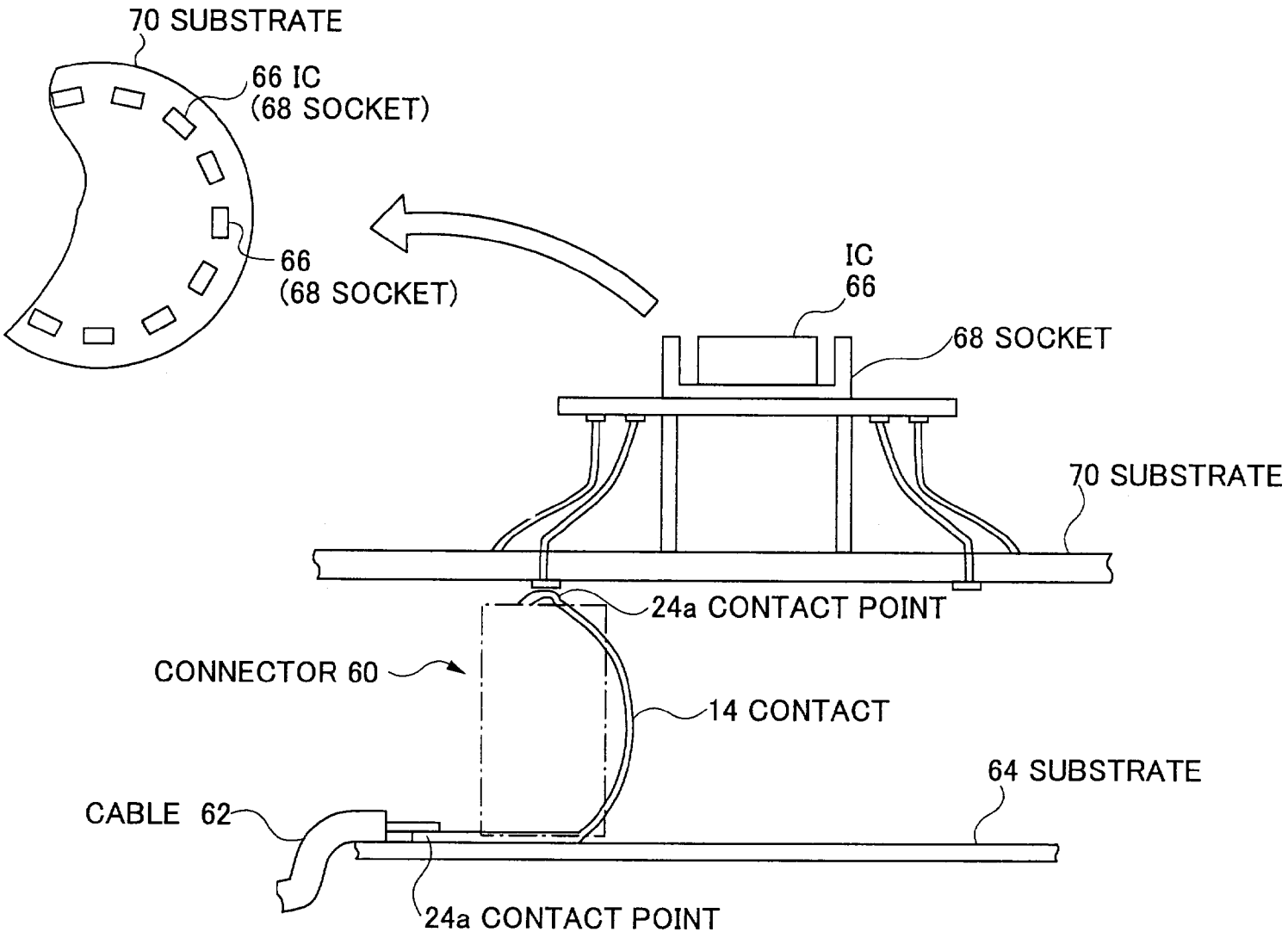
FIG. 15 is a diagram illustrating an employed state of a connector according to a second embodiment of the present invention.

In the following, the connector according to the second embodiment of the present invention will be described with reference to FIG. 15.

The basic structure of a connector 60 according to the second embodiment of the present invention is identical to that of the connector 30 according to the first embodiment. The connector 60 is different from the connector 30 in that one of its contact points is extended so as to be connected to a cable 62.

The connector 60 is a part of a testing apparatus used for continuity testing of an IC.

A fixing member (not shown) fixes the connector 60 to a substrate 64, which is a part of the testing apparatus. The contact 14, in other words, the contact point 24*a* of the contact module extending towards the cable 62, is connected to a circuit of the testing apparatus (not shown) via the cable 62.

On another substrate 70, a plurality of sockets 68 are arranged in a circle, and an IC (semiconductor device) 66 that is to be tested is placed in each of the sockets 68. The sockets 68 and the substrate 70 accommodating the sockets 68 are connected with wiring.

The continuity testing of the above IC 66 is realized by connecting a terminal arranged at a bottom surface of the substrate 70 to the upper contact point 24*a* of the connector 60.

Note that the advantageous effects of the connector 60 according to the second embodiment of the present invention are the same as that of the connector 30 according to the first embodiment.

Further, the present invention is not limited to these embodiments, and variations and modifications may be made without departing from the scope of the present invention.

The present application is based on and claims the benefit of the earlier filing date of Japanese priority application No.2002-193884 filed on Jul. 2, 2002, the entire contents of which are hereby incorporated by reference.

What is claimed is:

1. A connector that connects principal planes of two substrates, comprising:

a connector main body;

a contact module that is arranged on said connector main body, wherein said contact module comprises:

a sheet made of metal;

an insulating film formed on said sheet; and a contact point and a circuit pattern that are thin films of precious metal formed on said insulating film; wherein:

a plurality of said contact points and said circuit patterns are arranged to form a plurality of contacts, the contact module being bent into a C-shaped structure along an extending direction of said contacts to be implemented on the connector main body, and two protruding portions of said C-shaped structure of said contact module corresponding to said contact points; and a push member that applies pressure to said contact points so as to push open the two protruding portions of said C-shaped structure of said contact module, said push member being arranged inside the two protruding portions of said C-shaped structure.

2. The connector as claimed in claim 1, wherein said push member includes at least a pair of slide members that can slide out to push said contact points corresponding to said two protruding portions, and an elastic member, arranged between each said pair of slide members, that controls said pair of slide members to slide out and push said contact points.

3. The connector as claimed in claim 1, wherein said push member includes at least a pair of slide members that can slide out to push said contact points corresponding to said two protruding portions, and a positioning member, arranged between each said pair of slide members, that correctly positions said pair of slide members so as to push said contact points by sliding said pair of slide members.

4. A connector implemented in a testing apparatus that performs a continuity test on a semiconductor device, said connector connecting a circuit of said testing apparatus and a terminal of a substrate that is electrically connected to said semiconductor device, and comprising:

a connector main body;

a contact module that is arranged on said connector main body; wherein:

said contact module comprises:

a sheet made of metal;

an insulating film formed on said sheet; and a contact point and a circuit pattern that are thin films of precious metal formed on said insulating film, wherein:

a plurality of said contact points and said circuit patterns are arranged to form a plurality of contacts, said contact module being bent into a C-shaped structure along an extending direction of said contacts to be implemented on said connector main body, and two protruding potions of said C-shaped structure of said contact module corresponding to said contact points; and a push member that applies pressure to said contact points so as to push open the two protruding portions of said C-shaped structure of said contact module, said push member being arranged inside the two protruding portions of said C-shaped structure.

5. The connector as claimed in claim 4, wherein said push member includes at least a pair of slide members that can slide out to push said contact points corresponding to said two protruding portions, and an elastic member, arranged between each said pair of slide members, that controls said pair of slide members to slide out and push said contact points.

6. The connector as claimed in claim 4, wherein said push member includes at least a pair of slide members that can slide out to push said contact points corresponding to said two protruding portions, and a positioning member, arranged between each said pair of slide members, that correctly positions said pair of slide members so as to push said contact points by sliding said pair of slide members.

7. A connector, comprising:

a main body;

a contact module on said connector main body, comprising:

a base formed of a metal sheet, and an insulating film formed on said sheet; and a push member to push open the contact module, wherein said contact module further comprises a contact point and a circuit pattern comprising thin films of precious metal formed on said insulating film, a plurality of said contact points and said circuit patterns arranged to form a plurality of contacts, and the contact module is bent into a C-shaped structure along an extending direction of said contacts, the C-shaped structure comprising a plurality of protruding portions to correspond to said contact points.

8. A connector that connects principal planes of two substrates, comprising:

a main body; and a contact module on said main body, comprising:

a sheet made of metal, an insulating film on said sheet, and a contact point and a circuit pattern comprising thin films of precious metal on said insulating film, a plurality of said contact points and said circuit patterns being arranged to form a plurality of contacts, the contact module being bent into a C-shaped structure along an extending direction of said contacts to be implemented on the main body, and first and second protruding portions of said C-shaped structure corresponding to said contact points; and a push member to apply pressure to said contact points to push open the protruding portions of said C-shaped structure, said push member being arranged inside the protruding portions of said C-shaped structure.

* * * * *